US009227814B2

(12) United States Patent
Zhang

(10) Patent No.: US 9,227,814 B2
(45) Date of Patent: Jan. 5, 2016

(54) IMAGE FORMING APPARATUS

(71) Applicant: Brother Kogyo Kabushiki Kaisha, Nagoya-shi, Aichi-ken (JP)

(72) Inventor: Wei Zhang, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/555,229

(22) Filed: Nov. 26, 2014

(65) Prior Publication Data

US 2015/0145197 A1 May 28, 2015

(30) Foreign Application Priority Data

Nov. 27, 2013 (JP) ..... 2013-245364

(51) Int. Cl.
*B65H 29/14* (2006.01)
*B65H 85/00* (2006.01)

(52) U.S. Cl.
CPC ..... *B65H 85/00* (2013.01); *B65H 29/14* (2013.01); *B65H 2301/512565* (2013.01); *B65H 2403/942* (2013.01); *B65H 2404/144* (2013.01); *B65H 2404/71* (2013.01); *B65H 2404/7412* (2013.01); *B65H 2801/27* (2013.01)

(58) Field of Classification Search
CPC ..... B65H 29/00; B65H 29/12; B65H 29/125; B65H 29/14; B65H 85/00
USPC ..... 271/314, 902, 189
See application file for complete search history.

(56) References Cited

U.S. PATENT DOCUMENTS

| | | | | |
|---|---|---|---|---|
| 5,014,976 | A * | 5/1991 | Muck et al. | 271/220 |
| 5,344,130 | A * | 9/1994 | Suzuki | B42C 1/12 270/58.02 |
| 5,549,292 | A * | 8/1996 | Plain | 271/291 |
| 5,882,004 | A * | 3/1999 | Padget | 271/119 |
| 8,439,357 | B2 * | 5/2013 | Arikawa et al. | 271/184 |
| 8,870,182 | B2 * | 10/2014 | Ogata et al. | 271/225 |
| 2003/0006547 | A1 * | 1/2003 | Lee | B41J 13/106 271/189 |
| 2009/0295061 | A1 * | 12/2009 | Honda et al. | 271/3.14 |

FOREIGN PATENT DOCUMENTS

| | | | |
|---|---|---|---|
| JP | 2008-174390 | A | 7/2008 |
| JP | 2012-211002 | A | 11/2012 |

* cited by examiner

*Primary Examiner* — David H Bollinger
(74) *Attorney, Agent, or Firm* — Banner & Witcoff, Ltd.

(57) ABSTRACT

An image forming apparatus includes an image forming unit, a sheet receiving portion, an ejection roller, and a restriction member. The ejection roller is configured to rotate in a forward direction to eject a recording sheet fed from the image forming unit to the sheet receiving portion, and to rotate in a reverse direction to return the recording sheet to the image forming unit. The restriction member is configured to move between a restriction position where the restriction member protrudes farther in a sheet ejection direction than a peripheral surface of the ejection roller and a retracted position where the restriction member is retracted from the restriction position. The ejection roller is configured to move the restriction member to the restriction position by rotating in the forward direction, and to move the restriction member to the retracted position by rotating in the reverse direction.

13 Claims, 7 Drawing Sheets

92
130
110
140
F2
F1
122
320
120
310
200
300
121A
121B
121
F(10)
11
G
TOP
REAR
LEFT
RIGHT
FRONT
BOTTOM

IMAGE FORMING APPARATUS

CROSS REFERENCE TO RELATED APPLICATION

This application claims priority from Japanese Patent Application No. 2013-245364, filed on Nov. 27, 2013, which is incorporated herein by reference in its entirety.

TECHNICAL FIELD

Aspects of the disclosure relate to an image forming apparatus including an ejection roller configured to rotate in both forward and reverse directions.

BACKGROUND

Some known image forming apparatuses include an ejection roller configured to rotate in both forward and reverse directions. The ejection roller is configured to rotate in the forward direction to feed a recording sheet ejected from an image forming unit toward a sheet receiving proportion and configured to rotate in the reverse direction to return the recording sheet to the image forming unit.

One image forming apparatus including such an ejection roller is provided with a restriction member configured to, when the ejection roller rotates in the reverse direction, protrude from under the ejection roller toward the sheet receiving portion. In the image forming apparatus, when a recording sheet already ejected onto the sheet receiving portion is drawn and raised, due to static electricity, by a recording sheet to be fed to the ejection roller, the restriction member prevents the recording sheet raised from the sheet receiving portion from being drawn to the ejection roller by holding the raised recording sheet down to the sheet receiving portion.

Another image forming unit includes a restriction member pivotally attached to the main body and urged by a spring in a direction where the restriction member is retracted inside the main body relative to the ejection roller. The restriction member is configured to, when a recording sheet fed to the ejection roller contacts the ejection roller, pivot and protrude to the sheet receiving portion further than the ejection roller.

Still another image forming apparatus includes a restriction member engaged with a solenoid controlled by a controlling unit. When the ejection roller rotates in the reverse direction, the controlling unit operates the solenoid to cause the restriction member to protrude to the sheet receiving portion further than the ejection roller.

SUMMARY

However, in the above image forming apparatuses, structures for moving the restriction member are complicated.

Illustrative aspects of the disclosure provide an image forming apparatus configured to prevent a recording sheet on a sheet receiving portion from being drawn into an ejection roller with a simple structure.

According to an aspect of the disclosure, an image forming apparatus includes an image forming unit configured to form an image on a recording sheet, a sheet receiving portion configured to receive the recording sheet having the image, an ejection roller, and a restriction member. The ejection roller is configured to rotate in a forward direction to eject the recording sheet fed from the image forming unit to the sheet receiving portion, and to rotate in a reverse direction to return the recording sheet to the image forming unit. The restriction member is configured to move between a restriction position where the restriction member protrudes farther in a sheet ejection direction than a peripheral surface of the ejection roller and a retracted position where the restriction member is retracted from the restriction position. The ejection roller is configured to move the restriction member to the restriction position by rotating in the forward direction, and to move the restriction member to the retracted position by rotating in the reverse direction.

With this structure, when a recording sheet being ejected is returned to the image forming unit, even if a recording sheet ejected on the sheet receiving portion is raised due to a static electricity, the raised recording sheet is blocked by the restriction member such that it does not contact the ejection roller. Thus, any ejected recording sheets resting on the sheet receiving portion can be prevented from being drawn into the ejection roller. The restriction member is configured to move by rotation of the ejection roller. With this simple structure, any ejected recording sheets resting on the sheet receiving portion can be prevented from being drawn into the ejection roller.

BRIEF DESCRIPTION OF THE DRAWINGS

Reference is made to the following description taken in connection with the accompanying drawings, like reference numerals being used for like corresponding parts in the various drawings.

DETAILED DESCRIPTION

An embodiment of the disclosure will be described with reference to the following drawings. The following description will be first made to a general structure of a color printer 1 as an example of an image forming apparatus according to the embodiment of the disclosure.

In the following description, the expressions "front", "rear", "upper or top", "lower or bottom", "right", and "left" are used to define the various parts when the color printer 1 is disposed in an orientation in which it is intended to be used.

Figure 1:
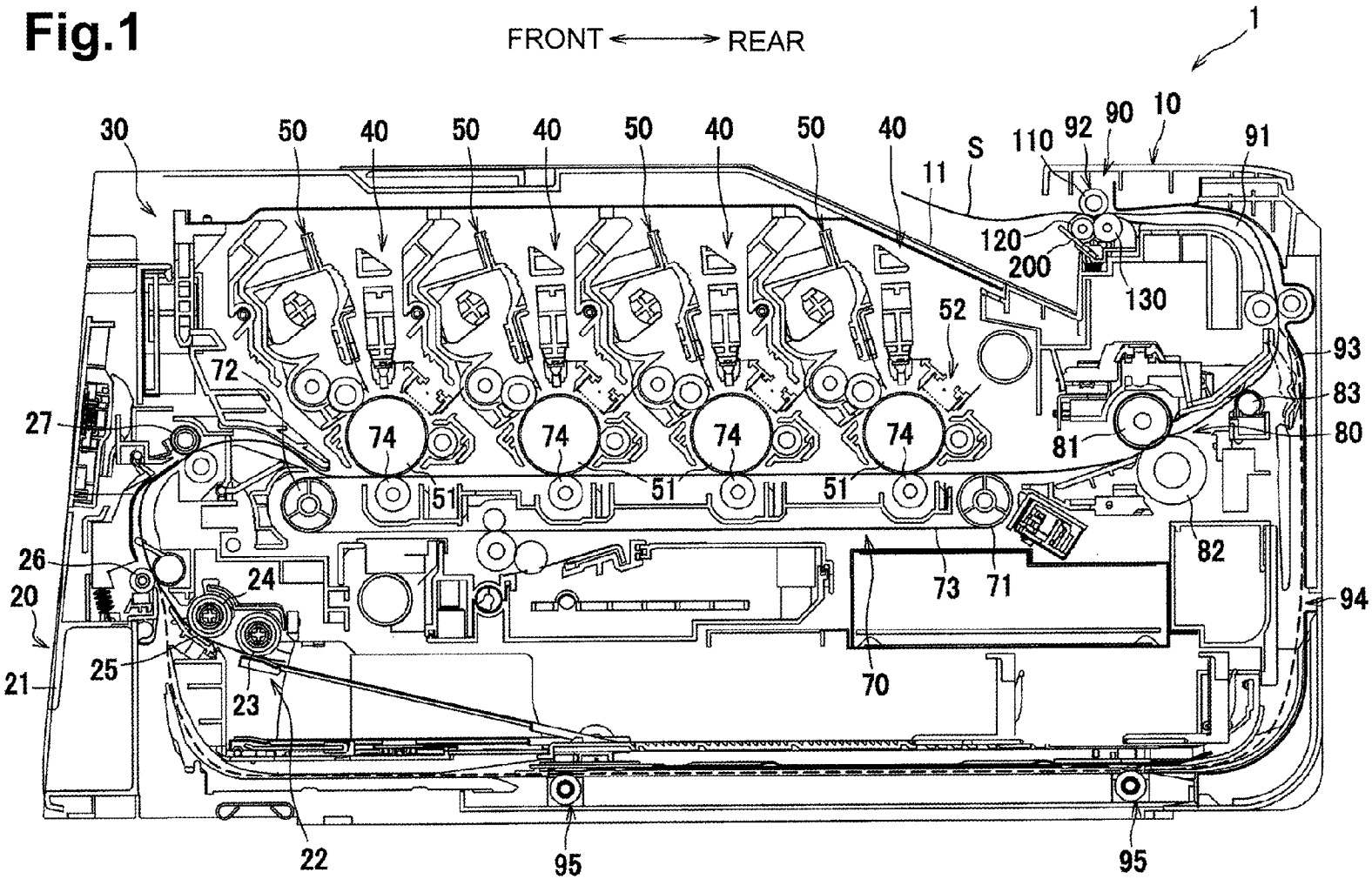
FIG. 1 is a sectional view illustrating a general structure of a color printer according to a first illustrative embodiment.

As shown in FIG. 1, the color printer 1 is configured to form images on both sides of a sheet S as an example of a recording sheet, and includes, in a main body 10, a sheet supply unit 20, an image forming unit 30, bad a feeding unit 90.

The main body 10 includes, on its upper surface, an ejection tray as an example of a sheet receiving portion configured to receive a sheet S having image formed thereon.

The sheet supply unit 20 is disposed in a lower portion of the main body 10. The sheet supply unit 20 includes a sheet supply tray 21 and a sheet supply mechanism 22. The sheet supply mechanism 22 is disposed in a front portion of the sheet supply tray 21, and includes a pickup roller 23, a separation roller 24, a separation pad 25, a paper dust removing roller 26, and a pair of registration rollers 27.

A sheet S accommodated in the sheet supply tray 21 is fed in a U-turn from the front side of the main body 10 toward the rear side by the sheet supply mechanism 22 and fed to the image forming unit 30. The sheet supply tray 21 is configured to be removed from the main body 10 by being pulled to the front and be attached to the main body 10 by being pressed to the rear.

The image forming unit 30 is disposed above the sheet supply tray 21, configured to form an image on a sheet S fed from the sheet supply unit 20, and includes four LED units 40, four process units 50, a transfer unit 70, and a fixing unit 80.

The LED units 40 each include a plurality of light emitting diodes, LEDs, at their lower ends, and are disposed above and facing respective photosensitive drums 51. The LED units 40 are configured to expose surfaces of the respective photosensitive drums 51 by causing the LEDs to blink based on image data.

The process units 50 area arranged in a front-rear direction, and each include a photosensitive drum 51, a charger 52, a developing roller, a supply roller, a layer thickness regulating blade, and a toner storing portion, which are illustrated without reference numerals.

The transfer unit 70 is disposed between the sheet supply tray 21 and the process units 50, and includes a drive roller 71, a driven roller 72, an endless conveyer belt 73 extending between the drive roller 71 and the driven roller 72, and four transfer rollers 74. The conveyor belt 73 is sandwiched between the photosensitive drums 51 contacting an outer surface of the conveyor belt 73 and the respective transfer rollers 74 disposed inside the conveyor belt 73.

The fixing unit 80 is disposed to the rear of the process units 50, and includes a heat roller 81 and a pressure roller 82 disposed facing the heat roller 81 to press the heat roller 81.

In the image forming unit 30, the surface of each photosensitive drum 51 is uniformly charged by the corresponding charger 52, and exposed to the light with light from the corresponding LED unit 40, and an electrostatic latent image based on image data is formed on the surface of each photosensitive drum 51. Toner in the toner storing portion is supplied via the supply roller to the developing roller, enters between the developing roller and the layer thickness regulating blade and is carried on the developing roller as a thin layer having a uniform thickness.

The toner carried on the developing roller is supplied from the developing roller to the electrostatic latent image formed on each photosensitive drum 51. Thereby, the electrostatic latent image is visualized as a toner image on each photosensitive drum 51. Then, when a sheet S is fed to between the photosensitive drums 51 and the conveyor belt 73, toner images on the photosensitive drums 51 are sequentially transferred and overlaid one over the other onto the sheet S.

The sheet S having the toner image transferred thereon is fed between the heat roller 81 and the pressure roller 82 and thermally fixed therebetween. In this way, images can be formed on the sheet S. The sheet S having images formed thereon is fed from the fixing unit 80 to a feed path 91 by a feed roller 83.

A feed unit 90 functions as an ejection mechanism configured to eject a sheet S fed from the image forming unit 30 outside of the main body 10 and functions also as a re-feed mechanism configured to re-feed a sheet S having an image on one side formed by the image forming unit 30 to the image forming unit 30 for forming an image on the other side of the sheet S. Specifically, the feed unit 90 includes the feed path 91, an ejection roller unit 92, a flapper 93 configured to pivot in the front-rear direction, a re-feed path 94, and a plurality of pairs of re-feed rollers 95 configured to feed the sheet S in the re-feed path 94.

The feed path 91 is defined in a rear portion of the main body 10, and extends upward from the front of flapper 93 pivoting to the rear (indicated with a solid line) and is bent to the front.

As described herein, the rotation of the ejection roller unit 92 refers to rollers 110, 120 and 130 of the ejection roller unit 92 each being configured to rotate in both forward and reverse directions about a respective rotational axis. The ejection roller unit 92 is configured to, when the rollers 110, 120 and 130 rotate in the forward direction, eject a sheet fed from the image forming unit 30 outside of the main body 10 or to the ejection tray 11, and configured to, when the rollers 110, 120 and 130 rotate in the reverse direction, draw the sheet S back to the main body 10.

The flapper 93 is configured to pivot to the rear when the sheet S fed from the image forming unit 30 is guided to the feed path 91, and configured to pivot to the front when the sheet S returned to the main body 10 by the reverse rotation of the ejection roller unit 92 is re-fed to the image forming unit 30.

The re-feed path 94 is for feeding a sheet S having an image on one side formed by the image forming unit 30 again to the image forming unit 30. The re-feed path 94 is defined in a U-shape in cross section in a rear portion, a lower portion, and a front portion of the main body 10. Specifically, the re-feed path 94 extends downward from behind the flapper 93 pivoting to the front (indicated with a chain line), is bent to the front, passes to the front under a sheet accommodating portion of the sheet supply tray 21, and is bent upward to the paper dust removing roller 26.

In the feed unit 90, when image formation is completed, the sheet S fed from the image forming unit 30 is fed along the feed path 91, and ejected outside of the main body 10 by rotating the ejection roller unit 92 in the forward direction and received onto the ejection tray 11. When another image is formed on the other side of a sheet S having an image on one side thereof, the sheet S being ejected is returned to the main body 10 by rotating the ejection roller unit 92 in a reverse direction before the entire of the sheet S is completely ejected outside of the main body 10. The returned sheet S is fed from the feed path 91 to the re-feed path 94. Thereafter, the sheet S (indicated by a broken line) is fed through the re-feed path 94 by re-feed rollers 95 and fed again to the image forming unit 30 by the sheet supply mechanism 22.

The sheet S having an image formed on the other side thereof by the image forming unit 30 is ejected outside of the main body 10 by the ejection roller unit 92 rotating in the forward direction and received on the ejection tray 11.

A structure in vicinity of the ejection roller unit 92 will be described below.

As shown in FIG. 1, the ejection roller unit 92 is disposed proximate to the ejection tray 11 at the rear thereof. In one example, the discharge port of the ejection roller unit 92 opens toward the ejection tray 11. The ejection roller unit 92 has a first roller 110, a second roller 120, as an example of an ejection roller, disposed below the first roller, and a third roller 130 disposed below the first roller 110 and at the rear of the second roller 120. A restriction member 200 is disposed below the second roller 120.

Figures 2A, 2B:
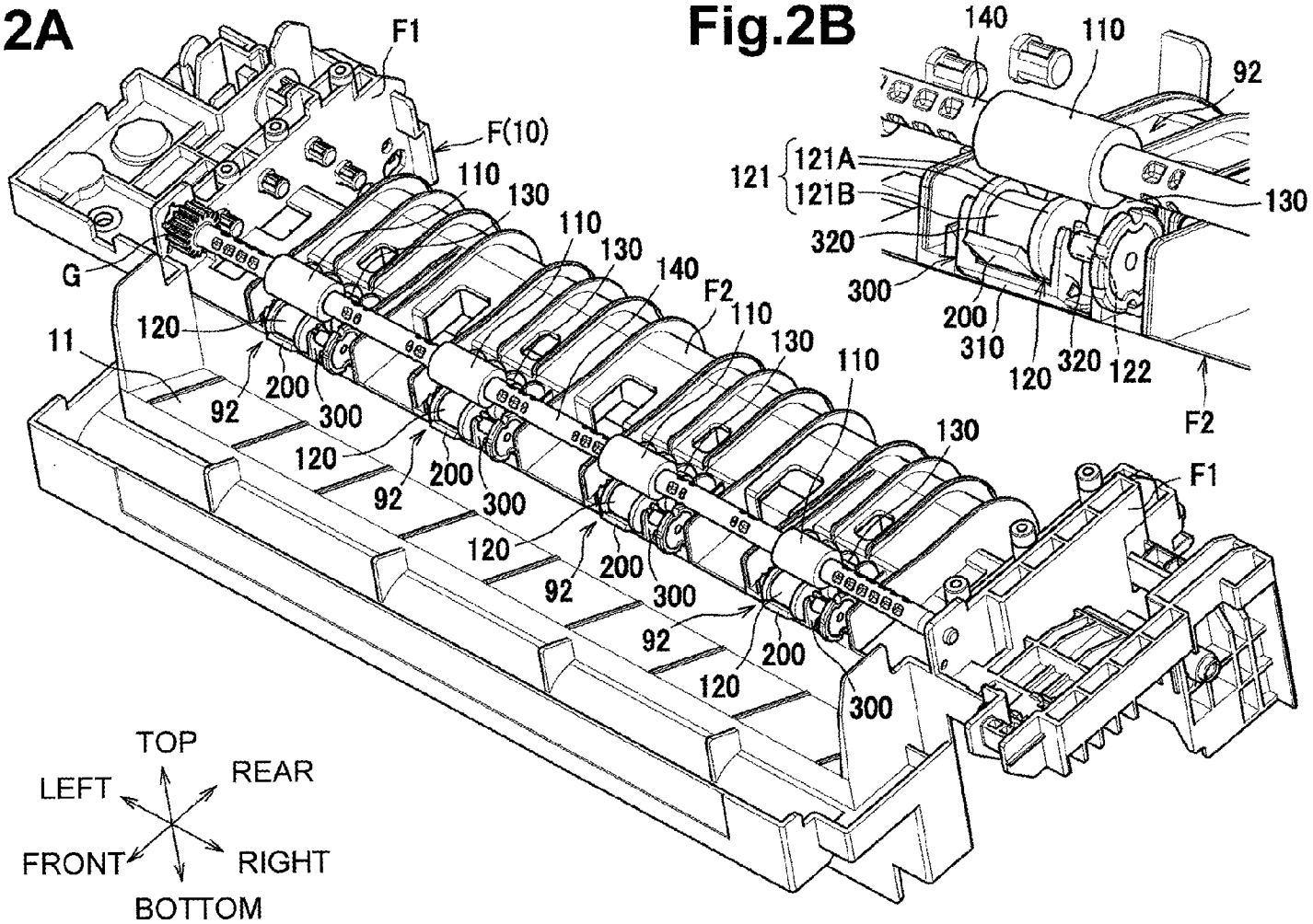
FIG. 2A is a perspective view of a plurality of ejection roller units of the color printer.
FIG. 2B is an enlarged perspective view of one of the ejections roller units of the color printer.

As shown in FIG. 2A, there is a plurality of ejection roller units 92 arranged in the left-right direction. The main body 10 includes a frame F for supporting the first rollers 110 rotatably and a plurality of roller holders 300 each for supporting the second roller 120 and the third roller 130 rotatably.

Each of the first rollers 110 is made of rubber and has a tubular shape. The first rollers 110 are fitted around a first roller shaft 140 having a gear G at a left end thereof and configured to rotate together with the first roller shaft 140. The gear G receives drive force from a drive source and the first roller 110 rotate.

The frame F includes a pair of left and right first frames F1, and a second frame F2 disposed below the first rollers 110 and connecting the left and right first frames F1. The left and right first frames F1 supports left and right end of the first roller shaft 140.

As shown in FIG. 1, the second roller 120 and the third roller 130 are disposed facing the first roller 110 such that a sheet S is sandwiched. The second roller 120 and the third roller 130 are configured to be rotated by friction with the first roller 110 or a sheet S caused by rotation of the first roller 110.

As shown in FIG. 2B, each second roller 120 includes a second roller body 121 as an example of a roller body, and a second roller shaft 122 as an example of a roller shaft. The second roller shaft 122 is rotatable with the second roller body 121.

The second roller body 121 has a pair of large-diameter portions 121A and a small-diameter portion 121B disposed between the large-diameter portions 121A and having a diameter smaller than the large-diameter portions 121A. The large-diameter portions 121A are made of resin such as polyoxymethylene (POM). The small-diameter portion 121B is made of rubber.

Figure 3A:
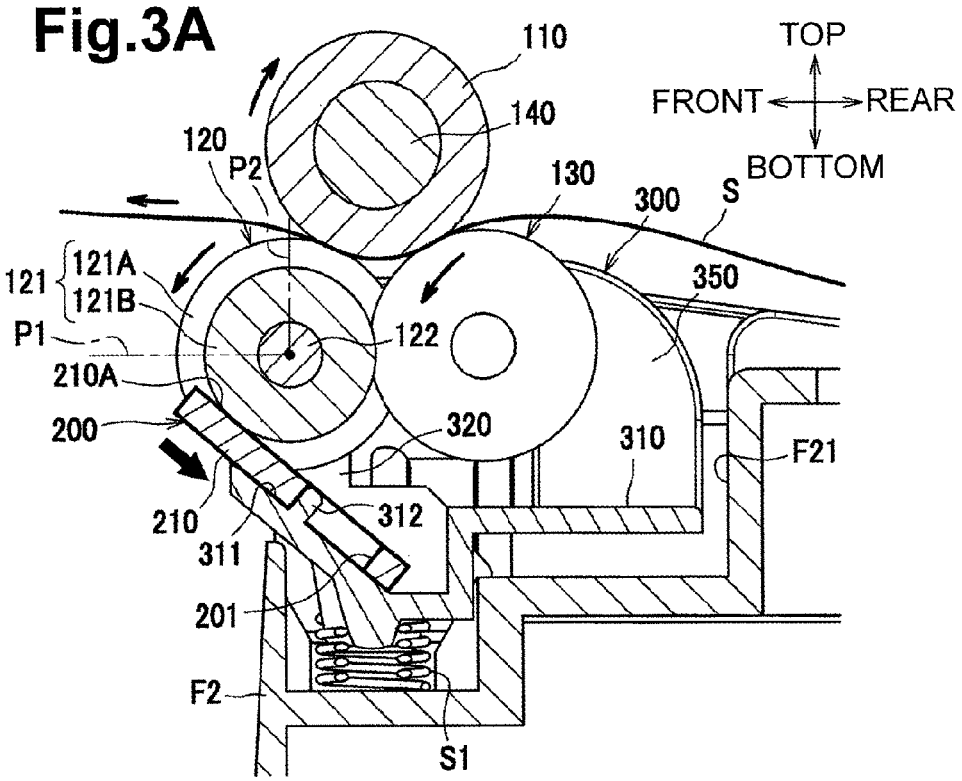
FIG. 3A is a sectional view of an ejection roller unit rotating in a forward direction and a restriction member.
Figure 3B:
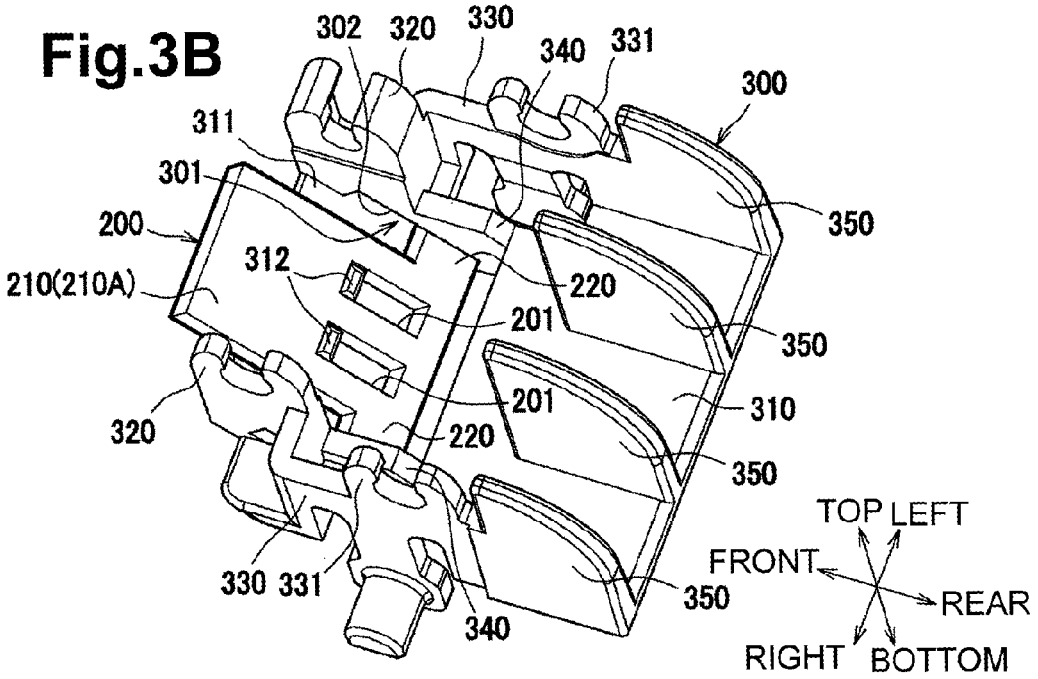
FIG. 3B is a perspective view of a roller holder and the restriction member.

The roller holder 300 includes a bottom portion 310 and a pair of second roller shaft supporting portions 320 as an example of a shaft supporting portion. The bottom portion 310 is disposed below the second roller 120. The second roller shaft supporting portions 320 are disposed at a front end portion of the bottom portion 310, and raised from left and right ends of the bottom portion 310 for supporting the second roller shaft 122. As shown in FIG. 3B, the roller holder 300 includes a pair of sidewall portions 330, a pair of extension portions 340, and a plurality of guide ribs 350. The sidewall portions 330 extend upward from the left and right ends of the bottom portion 310 behind the second roller shaft supporting portions 320. The extension portions 340 extend from lower end portions of the respective second roller supporting portions 320 and continue to the bottom portion 310. The guide ribs 350 are disposed at a lower end portion of the bottom portion 310.

The second roller shaft supporting portions 320 each have a C shape opening top to support the second roller shaft 122 therein (FIG. 2B).

The sidewall portions 330 each have a third roller shaft supporting portion 331 having a C shape opening top to support the third roller 130 therein.

The bottom portion 310 has an inclined surface 311 disposed between the second roller supporting portions 320 to guide the restriction member 200. As shown in FIG. 3A, the inclined surface 311 extends from behind the second roller shaft supporting portion 320 to a front end of the bottom portion 310, and is inclined upward to the front or the ejection tray 111.

As shown in FIG. 3B, the inclined surface 311 has a pair of protrusions 312, as an example of engaging portion, arranged in the left-right direction at a center portion of the inclined surface 311. In other words, the protrusions 312 are disposed between the second roller supporting portions 320.

Figure 5:
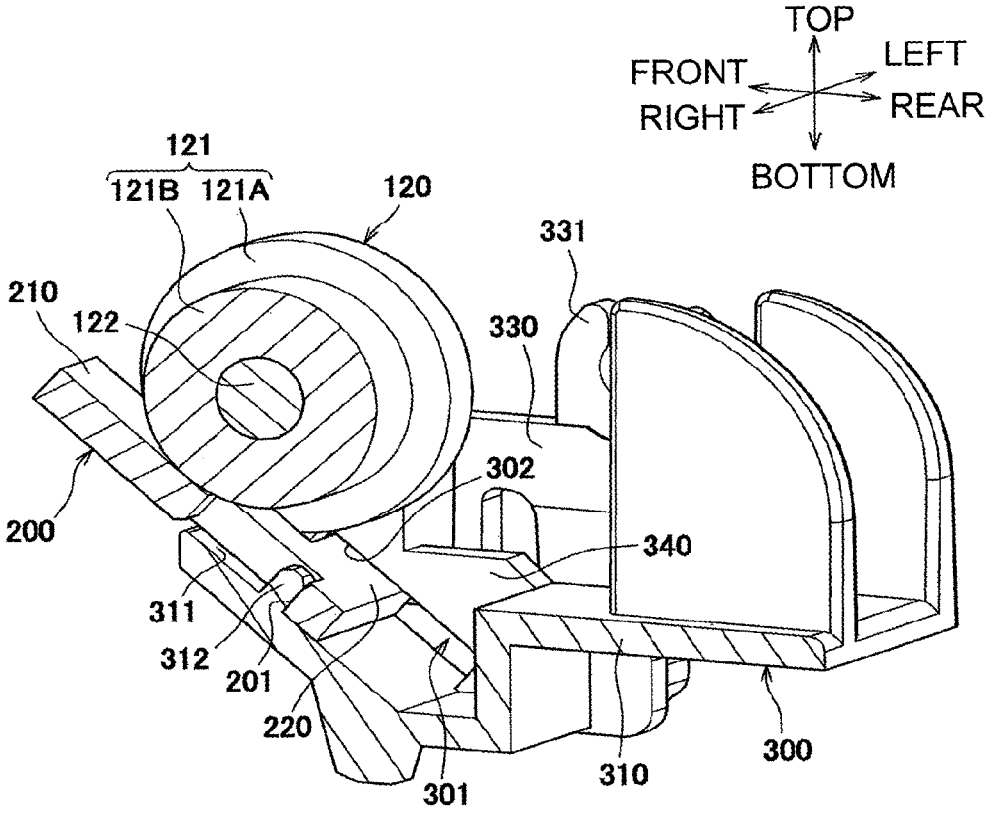
FIG. 5 is a view of a second roller, the restriction member, and the roller holder when the restriction member is in a restriction position.

A slit 301 is provided in the second roller shaft supporting portion 320 and the extension portion 340 disposed on each of the left and right sides of the inclined surface 311. FIGS. 3B and 5 show a left-side slit 301. The slit 301 is open inside in the left-right direction and extends along the inclined surface 311 from a lower end of the second roller shaft supporting portion 320 to a rear portion of the extension portion 340.

The guide ribs 350 are arranged in the left-right direction, and outermost guide ribs 350 are provided as portions of the sidewall portions 330. Each guide rib 350 has an upper end surface, which is arcuate and extends upward to the front, to guide a sheet S fed from the rear side to between the first roller 110 and the third roller 130.

As shown in FIG. 3A, the roller holder 300 structured as described above is disposed within a recessed portion F21 of the second frame F2 and urged upward by a spring 51 disposed between the recessed portion F21 and the roller holder 300. In other words, the second roller 120 and the third roller 130 supported by the roller holder 300 are urged to the first roller 110 by the spring S1.

As shown in FIG. 3B, the restriction member 200 is a plate-like member made of resin such as POM, and is slidably supported by the roller holder 300. In other words, the roller holder 300 is an example of a supporting member for supporting the restriction member 200.

The restriction member 200 includes a first portion 210, as an example of a second surface portion, extending in the front-rear direction along the inclined surface 311 of the roller holder 300 and having a rectangular shape, and a second portion 220, as an example of a first surface portion, extending from the rear end portion of the first portion 210. The second portion extends further outwardly in the left-right direction than the first portion 210. The first portion 210 is disposed on the inclined surface 311 and left and right end portions of the second portion 220 are disposed in the left and right slits 301, respectively.

The first portion 210 has left and right openings 201 each extending in the front-rear direction. The protrusions 312 of the inclined surface 311 extend into respective openings 201.

The first portion 210 is greater than the inclined surface 311 in size in the front-rear direction and is substantially the same as the small-diameter portion 121B of the second roller 120 in size in the left-right direction (FIG. 2B). A lower front surface of the small-diameter portion 121B of the second roller 120 contacts at least a portion of an upper surface 210A protruding to the front side further than the inclined surface 311 (FIG. 3A).

Figure 4:
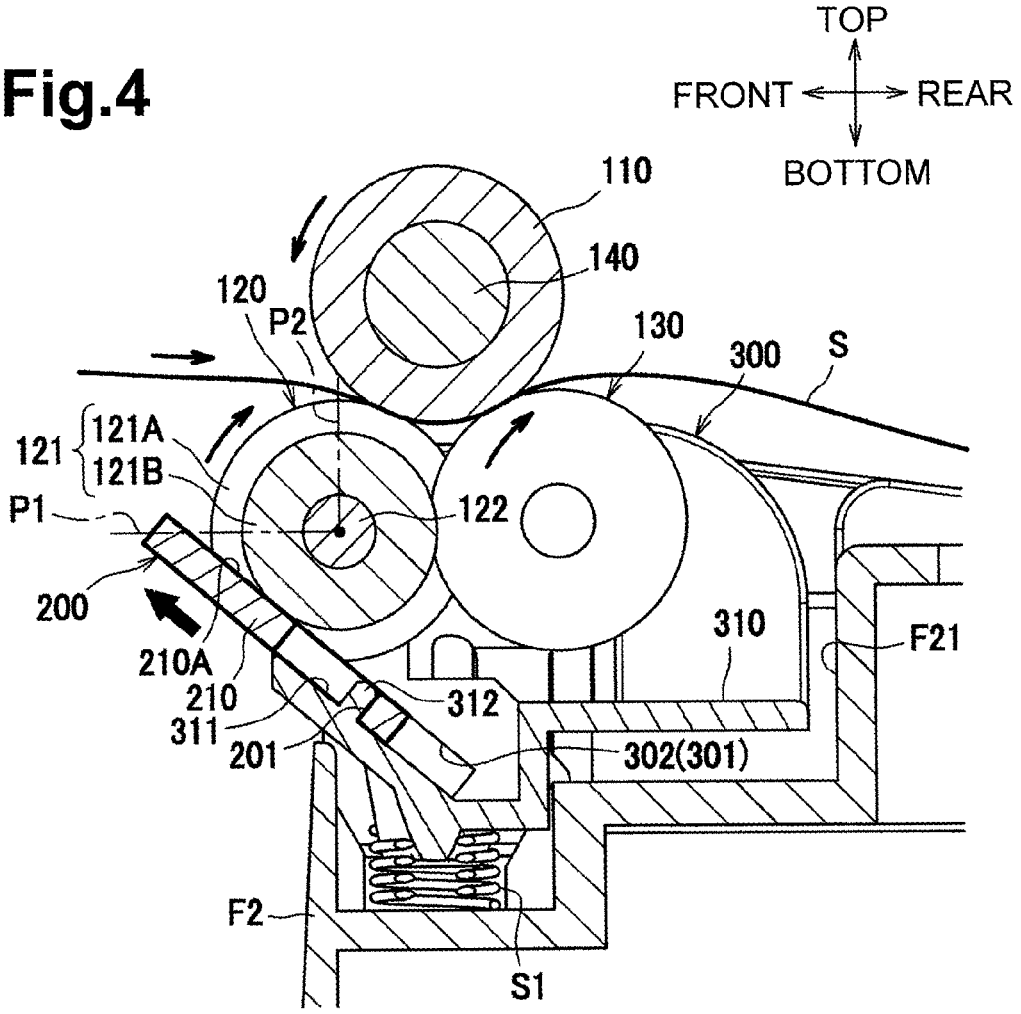
FIG. 4 is a sectional view of the ejection roller unit rotating in a reverse direction and the restriction member.

The restriction member 200 structured as described above is configured to slide along the inclined surface 311 between a restriction position shown in FIG. 4 and a retracted position shown in FIG. 3A. In the restriction position, the protrusion 312 contacts a first side surface defining a lower end of the opening 201 and the restriction member 200 protrudes to the front side or the ejection tray 11 further than the second roller 120. In the retracted position, the protrusion 312 contacts a second side surface defining an upper end of the opening 201 and the restriction member 200 is retracted inside of the roller holder 300 further than in the restriction position.

More specifically, as shown in FIG. 4, when the restriction member 200 is in the restriction position, the restriction member 200 protrudes farther in a sheet ejection direction than a peripheral surface of the second roller 120, that is, the upper end of the restriction member 200 protrudes outwardly further than the peripheral surface of the second roller 120, and upwardly and frontwardly beyond a rotational axis of the second roller 120 when viewed in an axial direction of the second roller 120 or in the left-right direction. In other words, the restriction member 200 disposed in the restriction position extends diagonally upwardly from a lower portion of the second roller 120 toward the front side of the color printer 1. In one example, the upper end of the restriction member 200 is disposed above a horizontal plane P1 passing through the axis of the second roller 120 and in front of a vertical plane P2 passing through the axis of the second roller 120. As shown in FIG. 3A, when the restriction member 200 is in the retracted position, it is disposed diagonally downwardly further than the restriction member 200 in the restriction position, and the upper end of the restriction member 200 is disposed below the axis of the second roller 120. In other words, the restriction member 200 in the retracted position extends diagonally upwardly from a lower portion of the second roller 120 to the front side of the color printer 1, and the upper end of the restriction member 200 is disposed below the horizontal plane P1 passing through the axis of the second roller 120.

Operation and effects of the color printer 1 structured as described above will be described.

When a sheet S is ejected onto the ejection tray 11, the ejection roller unit 92 rotates in the forward direction as shown in FIG. 3A. At this time, the second roller 120 rotates counterclockwise as shown in FIG. 3A. The first roller 110 rotates clockwise and the third roller 130 rotates counterclockwise as shown in FIG. 3A.

When the second roller 120 rotates in the forward direction, friction is produced between the small-diameter portion 121B of the second roller 120 and the restriction member 200, and the restriction member 200 moves along the inclined surface 311 toward the inside of the roller holder 300. At this time, the protrusion 312 of the roller holder 300 contacts the second side surface defining the upper end of the opening 201 in the restriction member 200 to restrict the movement of the restriction member 200 such that the restriction member 200 is maintained in the retracted position.

While the ejection roller unit 92 rotates in the forward direction to eject the sheet S, the restriction member 200 is in the retracted position. Thus, the sheet S being ejected is prevented from getting caught on the restriction member 200.

When the sheet S is returned to the main body 10 to be re-fed to the image forming unit 30, the ejection roller unit 92 rotates in the reverse direction. At this time, the second roller 120 rotates clockwise as shown in FIG. 4. The first roller 110 rotates counterclockwise and the third roller 130 rotates clockwise as shown in FIG. 4.

When the second roller 120 rotates in the reverse direction, friction is produced between the small-diameter portion 121B of the second roller 120 and the restriction member 200, and the restriction member 200 moves along the inclined surface 311 diagonally upwardly toward the front of the color printer 1. At this time, the protrusion 312 of the roller holder 300 contacts the first side surface defining the lower end of the opening 201 of the restriction member 200 to restrict the movement of the restriction member 200 such that the restriction member 200 is maintained in the restriction position.

In the embodiment, as the second roller 120 contacts a portion of the restriction member 200 not in contact with the inclined surface 311, the restriction member 200 may be caused to rotate counterclockwise in FIG. 3 about an upper end of the inclined surface 311. However, as shown in FIGS. 3B and 5, an upper end 302 (a contact portion) of the slit 301 contacts an upper surface of the second portion 220 of the restriction member 200 at a downstream position relative to a contact position where the second roller 120 contacts the restriction member 200 in a direction where the restriction member 200 is retracted. Thus, the restriction member 200 is prevented from rotating.

Figure 6:
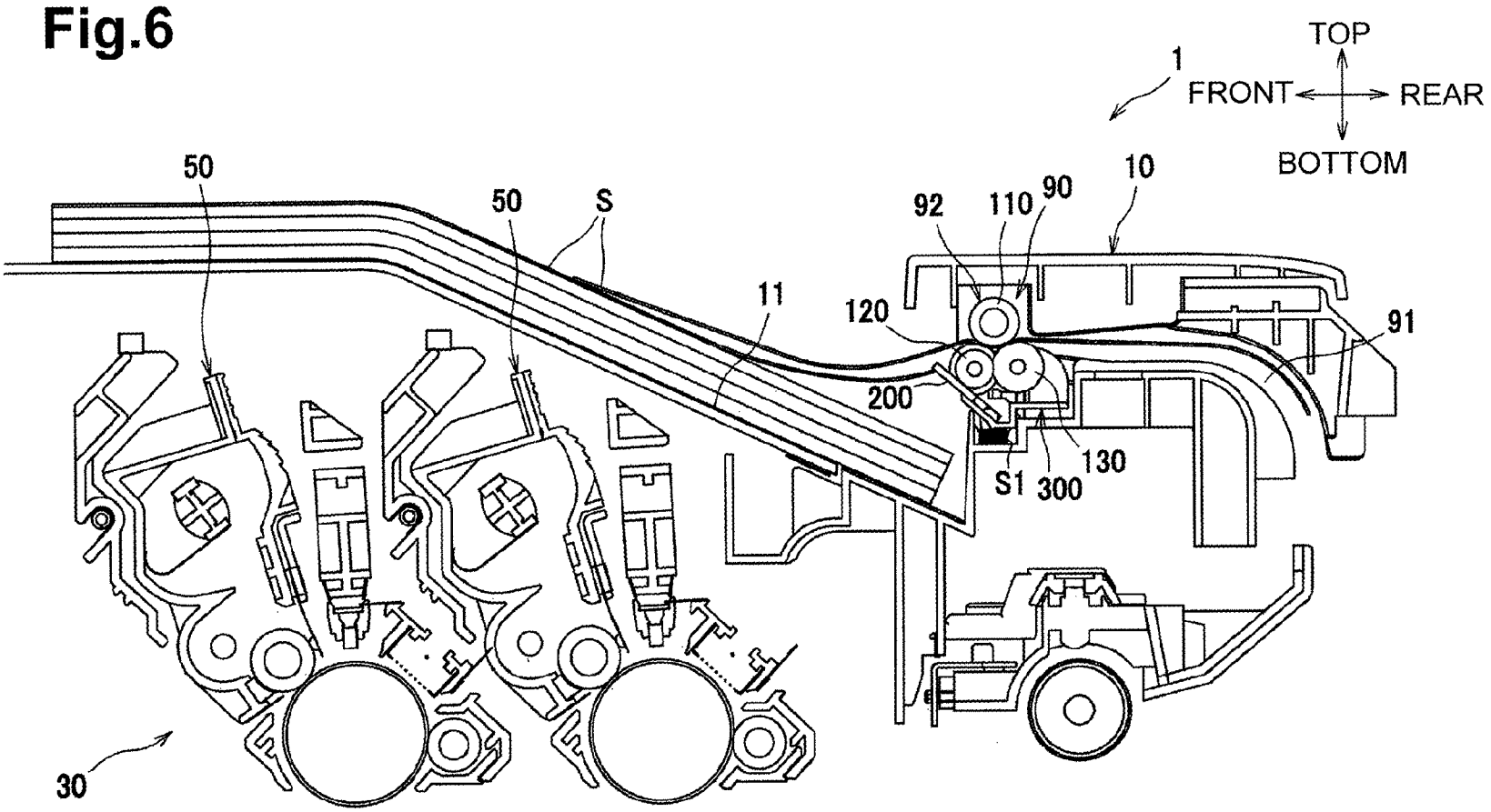
FIG. 6 illustrates that a sheet on an ejection tray is raised in contact with the restriction member.

As shown in FIG. 6, when the restriction member 200 is in the restriction position, even if an ejected sheet S resting on the ejection tray 11 is raised due to static electricity when a sheet S is being returned to the main body 10, the raised sheet S is blocked by the restriction member 200 such that it does not contact the second roller 120. With this structure, any ejected sheets S resting on the ejection tray 11 can be restricted from being drawn into the ejection roller unit 92.

If a raised sheet S on the ejection tray 11 contacts a portion of the peripheral surface of the second roller 120, which is above the axis of the second roller 120 and closer to the ejection tray 11, the sheet S is likely to be drawn into the ejection roller unit 92. In this embodiment, when the restriction member 200 is in the restriction position, the upper end of the restriction member 200 is disposed above the axis of the second roller 120 and between the ejection tray 11 and a portion of the second roller 120 above the axis of the second roller 120. Thus, the restriction member 200 can reliably restrict a sheet S resting on the ejection tray 11 from being drawn into the ejection roller unit 92.

The restriction member 200 is configured to move by receiving a force from rotation of the second roller 120. Thus, the restriction member 200 can prevent a sheet S from being drawn into the ejection roller unit 92 with a simple structure. In the embodiment, the restriction member 200 is in contact with the second roller 120, and the restriction member 200 moves due to friction between the restriction member 200 and the second roller 120. Thus, the restriction member 200 can move between the restriction position and the retracted position with a simple structure.

When the restriction member 200 is in one of the restriction position and the retracted position, the movement of the restriction member 200 is restricted by the protrusion of the roller holder 300 contacting a side surface defining an end of the opening 201. This structure allows the restriction member 200 to move within a specified range.

The roller holder 300 supports the restriction member 200 as well as the second roller 120. The restriction member 200 is disposed in close vicinity to the second roller 120 and the movement of the restriction member 200 is minimized.

The inclined surface 311, the openings 201, and the protrusions 312 are disposed between the pair of second roller shaft supporting portions 320. The need for increasing the physical size of the main body 10 can be minimized compared with a case where the inclined surface 311, the openings 201, and protrusions 312 are offset in the front-rear or left-right direction relative to the second roller shaft supporting portions 320.

The embodiment shows, but is not limited to, the restriction member 200 being configured to move between the restriction position and the retracted position by sliding. For example, as shown in FIGS. 7A and 7B, a restriction member 400 may be configured to move between the restriction position and the retracted position by rotating.

Specifically, the restriction member 400 includes a ring portion 410, a restricting portion 420, and a stopper 430. The ring portion 410 is configured to engage the small-diameter portion 121B of the second roller 120. The restricting portion 420 extends radially outwardly from the ring portion 410 and an end of the restriction portion 420 protrudes from the large-diameter portion 121A when viewed in the left-right direction. The stopper 430 extends radially outwardly from the ring portion 410 within the roller holder 300.

Figure 7A:
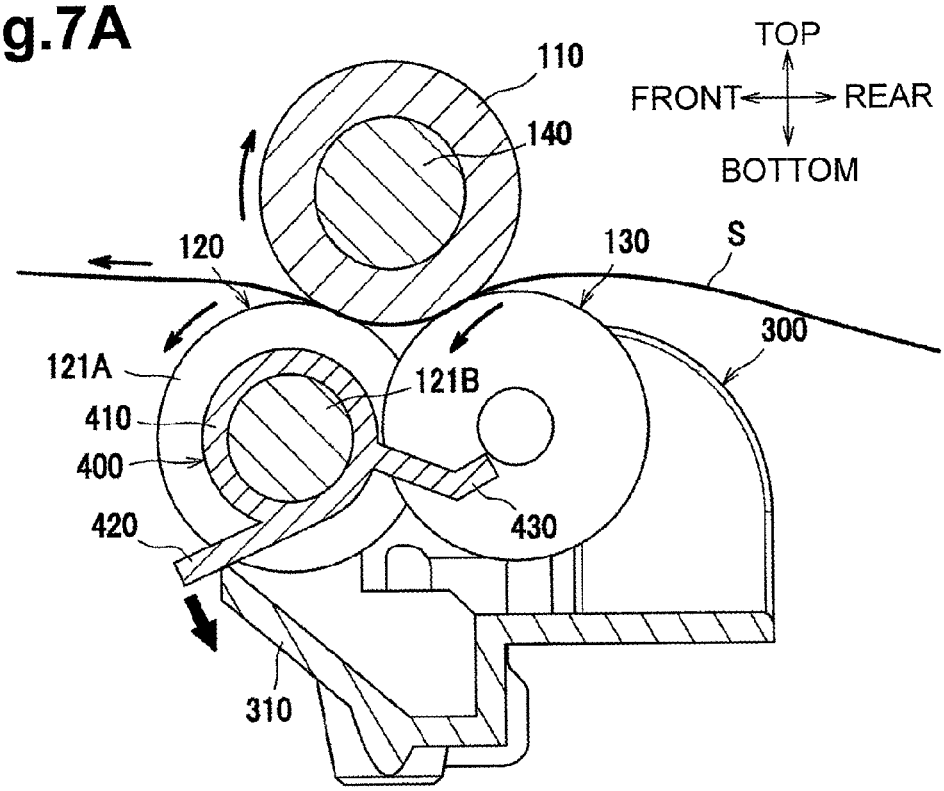
FIG. 7A is a sectional view of an ejection roller unit rotating in a forward direction and a restriction member according to a modification.

As shown in FIG. 7A, when the second roller 120 rotates in the forward direction, the restriction member 400 rotates counterclockwise due to friction between the small-diameter portion 121B and the ring portion 410. At this time, the restricting portion 420 contacts the bottom portion 310 of the roller holder 300 to restrict the rotation of the restriction member 400 and to allow the restriction member 400 to be in the retracted position.

Figure 7B:
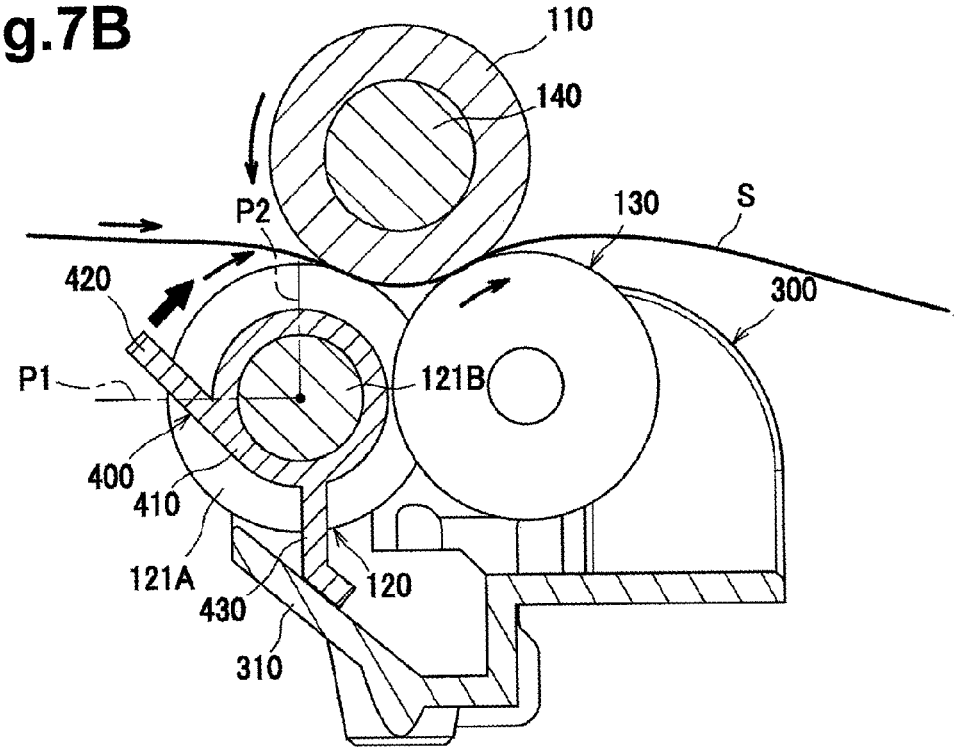
FIG. 7B is a sectional view of the ejection roller unit in a reverse direction and the restriction member.

As shown in FIG. 7B, when the second roller 120 rotates in the reverse direction, the restriction member 400 rotates clockwise due to friction between the small-diameter portion 121B and the ring portion 410. At this time, the stopper 430 contacts the bottom portion 310 of the roller holder 300 to restrict the rotation of the restriction member 400 and to allow the restriction member 400 to be in the restriction position. When the restriction member 400 is in the restriction position, the restricting portion 420 protrudes outwardly relative to the peripheral surface of the second roller 120 and upwardly and frontwardly relative to the axis of the second roller 120. In other words, when the restriction member 400 is in the restriction position, the end of the restricting portion 420 is disposed in front of the second roller 120. In one example, the end of the restriction portion 420 is disposed above the horizontal plane P1 passing through the axis of the second roller 120 and to the front of the vertical plane P2 passing through the axis of the second roller 120.

Even with this structure, the restriction member 400 is configured to move between the restriction position and the retracted position by receiving a force from rotation of the second roller 120. Thus, the restriction member 400 can prevent a sheet S resting on the ejection tray 11 from being drawn into the ejection roller unit 92 with a simple structure.

The embodiment shows, but is not limited to, a configuration where, when the restriction member 200 is in the restriction position, the upper end of the restriction member 200 is disposed above the axis of the second roller 120. The upper end of the restriction member disposed in the restriction position might not be disposed above the axis of the second roller 120 as long as the upper end of the restriction member may protrude outwardly relative to the peripheral surface of the second roller 120 and protrude toward the ejection tray 11 relative to the axis of the second roller 120, when viewed in an axial direction of the second roller 120.

The embodiment shows, but is not limited to, the restriction member 200 having the openings 201 and the roller holder 300 including the protrusions 312 configured to extend into the respective openings 201. For example, the roller holder 300 may have openings and the restriction member 200 may include protrusions to extend into the openings.

The embodiment shows, but is not limited to, the color printer 1 as an example of an image forming apparatus. The disclosure may be applied to a monochrome laser printer, a copier, and a multifunction apparatus.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

an image forming unit configured to form an image on a recording sheet;

a sheet receiving portion configured to receive the recording sheet having the image;

an ejection roller configured to rotate in a forward direction to eject the recording sheet fed from the image forming unit to the sheet receiving portion, and to rotate in a reverse direction to return the recording sheet to the image forming unit; and a restriction member configured to move between a restriction position where the restriction member protrudes farther in a sheet ejection direction than a peripheral surface of the ejection roller and a retracted position where the restriction member is retracted from the restriction position, wherein the ejection roller contacts at least a portion of the restriction member, the ejection roller being configured to move the restriction member to the restriction position by rotating in the reverse direction, and to move the restriction member to the retracted position by rotating in the forward direction.

2. The image forming apparatus according to claim 1, wherein, when the restriction member is in the restriction position, the restriction member protrudes upwardly beyond a rotational axis of the ejection roller when viewed in an axial direction of the ejection roller.

3. The image forming apparatus according to claim 1, wherein the restriction member is configured to move between the restriction position and the retracted position based on friction between the restriction member and the ejection roller.

4. The image forming apparatus according to claim 3, wherein the ejection roller includes a roller body and a roller shaft configured to rotate together with the roller body, wherein the roller body includes a first large-diameter portion, a second large-diameter portion and a small-diameter portion disposed between the first and second large-diameter portions, the small-diameter portion having a diameter smaller than the first and second large-diameter portions, and wherein the restriction member contacts the small-diameter portion.

5. The image forming apparatus according to claim 1, further comprising a supporting member for supporting the restriction member movably, wherein one of the restriction member and the supporting member has an opening extending in a direction in which the restriction member moves, and wherein the other one of the restriction member and the supporting member has an engaging portion configured to extend into the opening and to restrict movement of the restriction member by contacting a first side surface defining a first end of the opening when the restriction member is in the restriction position, and by contacting a second side surface defining a second end of the opening when the restriction member is in the retracted position.

6. The image forming apparatus according to claim 5, wherein the supporting member comprises a roller holder for supporting the ejection roller.

7. The image forming apparatus according to claim 6, wherein the ejection roller includes a roller body and a roller shaft configured to rotate together with the roller body, wherein the roller holder includes first and second shaft supporting portions supporting first and second end portions of the roller shaft, respectively, and wherein the opening and the engaging portion are provided between the first and second shaft supporting portions.

8. The image forming apparatus according to claim 5, wherein the supporting member has an inclined surface configured to guide the restriction member, and wherein the restriction member moves diagonally upwardly when the restriction member moves from the retracted position to the restriction position.

9. The image forming apparatus according to claim 5, further comprising a contact portion configured to contact a first surface portion of the restriction member, the first surface portion of the restriction member being disposed on a same side of the restriction member as a second surface portion of the restriction member configured to contact the ejection roller, wherein the first surface portion is disposed upstream of the second surface portion in the sheet ejection direction.

10. The image forming apparatus according to claim 9, wherein the first surface portion extends outwardly from the restriction member in an axial direction of the ejection roller.

11. The image forming apparatus according to claim 10, further comprising a roller holder supporting the ejection roller, wherein the roller holder includes the contact portion.

12. An image forming apparatus comprising:

an image forming unit configured to form an image on a recording sheet;

a sheet receiving portion configured to receive the recording sheet having the image;

an ejection roller configured to rotate in a forward direction to eject the recording sheet fed from the image forming unit to the sheet receiving portion, and to rotate in a reverse direction to return the recording sheet to the image forming unit;

a restriction member configured to move between a restriction position where the restriction member protrudes farther in a sheet ejection direction than a peripheral surface of the ejection roller and a retracted position where the restriction member is retracted from the restriction position; and a supporting member for supporting the restriction member movably between the restriction position and the retracted position, the supporting member having a support surface, the restriction member being configured to slide on the support surface, wherein one of the restriction member and the support surface of the supporting member includes a first engaging portion and the other one of the restriction member and the support surface of the supporting member includes a second engaging portion configured to engage the first engaging portion.

13. The image forming apparatus according to claim 12, wherein the first engaging portion includes a protrusion and the second engaging portion includes an opening.

* * * * *